US005655250A

United States Patent [19]

Warrell

[11] Patent Number: 5,655,250

[45] Date of Patent: Aug. 12, 1997

[54] FLOOR CLEANING IMPLEMENT

[76] Inventor: Ann M. Warrell, 606 Sunset Rd., Boynton Beach, Fla. 33435

[21] Appl. No.: 635,601

[22] Filed: Apr. 22, 1996

[51] Int. Cl.[6] ..... A47L 13/20; A47L 13/44

[52] U.S. Cl. ..... 15/228; 15/144.2; 15/147.2; 15/231; 15/247

[58] Field of Search ..... 15/144.2, 147.1, 15/147.2, 228, 231, 232, 244.2, 247; 403/79, 150, 157

[56] References Cited

U.S. PATENT DOCUMENTS

| | | | |
|---|---|---|---|
| D. 298,072 | 10/1988 | Stirling . | |
| 815,343 | 3/1906 | Garnet | 15/228 |
| 1,310,910 | 7/1919 | Hodschar | 15/228 |
| 1,677,741 | 7/1928 | Whitaker | 15/147.2 |
| 2,029,426 | 2/1936 | Kingdon | 15/231 |
| 2,509,687 | 5/1950 | Lee | 15/231 |
| 2,815,521 | 12/1957 | Winckler . | |
| 2,875,463 | 3/1959 | Minerely . | |
| 3,012,263 | 12/1961 | Nash . | |
| 3,034,165 | 5/1962 | Christian . | |
| 3,099,855 | 8/1963 | Nash . | |
| 3,465,377 | 9/1969 | Thomas . | |
| 3,850,533 | 11/1974 | Thielen | 403/157 |
| 4,047,260 | 9/1977 | Deutsch . | |
| 4,312,093 | 1/1982 | Raab . | |
| 4,794,663 | 1/1989 | Vosbikian | 15/144.2 |
| 4,845,800 | 7/1989 | Pederson | 15/228 |
| 4,858,267 | 8/1989 | Unger | 15/228 |
| 4,962,563 | 10/1990 | Bachar | 15/228 |
| 5,343,587 | 9/1994 | Findley | 15/228 |
| 5,410,772 | 5/1995 | Lewis . | |
| 5,426,809 | 6/1995 | Muta . | |

FOREIGN PATENT DOCUMENTS

| | | | |
|---|---|---|---|
| 907779 | 3/1946 | France | 15/244.2 |
| 1110749 | 2/1956 | France | 15/244.2 |
| 3000615 | 7/1981 | Germany | 15/228 |
| 4321596 | 1/1995 | Germany | 15/228 |
| 133424 | 8/1929 | Switzerland | 15/231 |
| 0600761 | 4/1948 | United Kingdom | 15/147.2 |

*Primary Examiner*—David Scherbel
*Assistant Examiner*—Randall Chin

[57] ABSTRACT

An improved floor cleaning implement for sweeping, dusting, and damp mopping a floor surface. The structure consists of an elongated handle (30) and an elongated tube or rod head member (20) which are connected by a two-way lateral pivoting hinge (24, 26, 28). A soft cut pile sleeve (22) slips over and encases the elongated tube or rod (20), and is used for dry dusting and sweeping. A dampened cloth towel (32) may be installed, by sliding the grommet (34) which lines an opening in the center of the cloth (32) over and down the elongated handle (30) to the sweep/dust sleeve (22), then draped over the sleeve (22), to be used for damp mopping, whereby the sleeve (22) serves as a cushion.

14 Claims, 4 Drawing Sheets

FLOOR CLEANING IMPLEMENT

BACKGROUND—FIELD OF INVENTION

This invention relates generally to floor dusters, mops, and brooms and specifically incorporates a lateral pivot hinge, which promotes a different dusting/sweeping/mopping technique, that is attached to an elongated narrow tube, encased by a sweeping and dusting sleeve upon which may be draped a damp cloth for mopping, both of which can be easily removed for laundering.

BACKGROUND—DESCRIPTION OF PRIOR ART

The technique of floor cleaning involved at least two separate implements in an effort to achieve the desired result of a clean floor. First, the floor needed to be broom swept, dust mopped or vacuumed and then wet mopped utilizing a string mop or sponge mop and bucket of water. These efforts were labor intensive, time consuming and achieved less than desired results. The bristle broom allowed some dirt to pass through, kicked some dust up into the air and dispersed some dirt particles back into the previously swept area. The dust mop was a flat dry string mop that became filthy with use and deteriorated quickly when laundered. The vacuum was bulky and laborious to maneuver. The string mop and the sponge or foam mop required a wringer device to expel excess water back into the bucket which became dirty water upon re-wetting, thereby putting soil contaminated water back on to the floor. These mops also left excess water on the floor which took considerable time to dry, causing the floor to be easily tracked and slippery. Subsequent prior art attempted to remedy these problems however with only limited success.

U.S. Pat. No. 2,815,521 to Winckler (1955) required installation of a large envelope over a dust mop. The size made it difficult to maneuver around obstacles. Also, the type of string dust mop referred to did not sweep debris particles proved less than effective as a dust mop.

U.S. Pat. No. 3,034,165 to Christian (1962) employed an attachment for a push broom to which a fabric cleaning element could be secured, however, a push broom has a rigid handle to headmember attachment. The fabric cleaning element was used for dusting and sweeping and taught dunking the whole push broom headmember, with cloth installed, into a water container, for what would be extremely wet mopping. Excess amounts of water used can cause water to be absorbed by certain types of floor surfaces, which can cause damage.

The French Patent 1.110.749 to Ponce (1956) taught using a thin, spongious envelope covered, flat wood block headmember to be dunked into a bucket of water for wet sweeping, dusting and mopping and utilized a vertical pivot, a type of pivot which nececitates a push and pull cleaning method. This technique causes soil and debris to be deposited at the furthest stopping points.

Other types of floor cleaning devices have incorporated a cloth or towel as the cleaning element-for example U.S. Pat. Nos. 3,012,264 (1964), 3,099,855 (1963), 3,465,377 (1969), 4,047,260 (1977), 5,343,587 (1994), 5,410,772 (1995), and 5,426,809 (1995), however none addresses sweeping, dusting, and damp mopping. All also suffer from various other disadvantages, such as:

(a) If the connection of the handle to the head member is rigid,the cleaning operation is limited to a push and pull technique that leaves soil at the furthest stopping points. It also makes maneuvering under and around obstacles difficult with insufficient results.

(b) If a universal joint serves as the attachment between the handle and head member, the implement is difficult to control, and mandates that a flat, single work surface headmember be utilized.

(c) If a rigid or moderately rigid material is employed as the work surface or cushion means over which is installed the cloth or towel cleaning element, at least moderate exertion is necessary which may cause scratching on the floor surface. While this may be beneficial for scrubbing, it is not desirable for routine maintenance.

(d) If a foam or sponge type material is employed as the work surface or cushion means over which is installed the cloth or towel cleaning element, their porous nature would cause them to absorb soiled liquid, which porous nature also makes it difficult to get it thoroughly clean. Absorbed liquid also causes these materials to deteriorate quickly.

(e) If clamps, bands and similar attachment devices are employed to secure the cloth or towel cleaning element, unnecessary time and effort is spent fumbling to install and remove. These devices also are prone to fail at some frequency while working, and eventually fail totally, requiting repair or replacement. These devices can also scratch and mar surrounding surfaces.

(f) If VELCRO loop material is employed to attach the cloth or towel cleaning element, it causes lint, debris and fibers to become entangled in the VELCRO loops which will be difficult to clean off and also cause the VELCRO to be less effective over time.

(g) If a standard size head member is utilized, more time and effort is required and it is difficult to achieve desired results.

SUMMARY OF THE INVENTION

Accordingly, objects and advantages of my invention are:

(a) to provide a light-weight floor cleaning implement which dusts, sweeps, and damp mops;

(b) to provide a floor cleaning implement which incorporates a lateral pivot hinge at the attachment point of the head and handle which promotes a superior and tire saving side to side "come along" sweeping, dusting, and damp mopping technique;

(c) to provide a floor cleaning implement that utilizes a soft,cut-pile, fabric lined, sweep/dust sleeve for dry dusting and sweeping that also serves as a superior cushion work surface over which is draped the damp towel or cloth cleaning element, which sleeve easily conforms to floor surface irregularities;

(d) to provide a floor cleaning implement that utilizes a soft, cut-pile, fabric lined, sweep/dust sleeve and cloth towel cleaning element, both of which may be easily removed and effectively laundered for future re-use;

(e) to provide a floor cleaning implement that utilizes a damp cloth towel cleaning element that easily slides over the handle and is simply draped over the sweep/dust sleeve, neither of which require attaachment devices so there is no danger scratching the floor surface, furniture or surrounding areas (baseboards), (f) to provide a floor cleaning implement that, when turned upside down, exposes additional clean sleeve or cloth cleaning element surface for continued cleaning;

(g) to provide a floor cleaning implement wherein the cloth cleaning element, when soiled on one side, can be easily removed from the implement, turned clean side out, reinstalled, and used for continued cleaning;

(h) to provide a floor cleaning implement that employs an elongated and narrow head member (tube or rod) for enlarged cleaning area coverage and ease of maneuverability in to corners and around furniture.

Further objects and advantages are to provide a floor cleaning implement that more quickly, easily and effectively cleans a floor surface and because no bucket of water is necessary, saves water, does not leave unsafe excess amounts of water on the floor, does not spread dirty, contaminated water back on to the floor, and allows the floor to dry quickly, all of which help preserve fine floor finishes.

Figure 1:
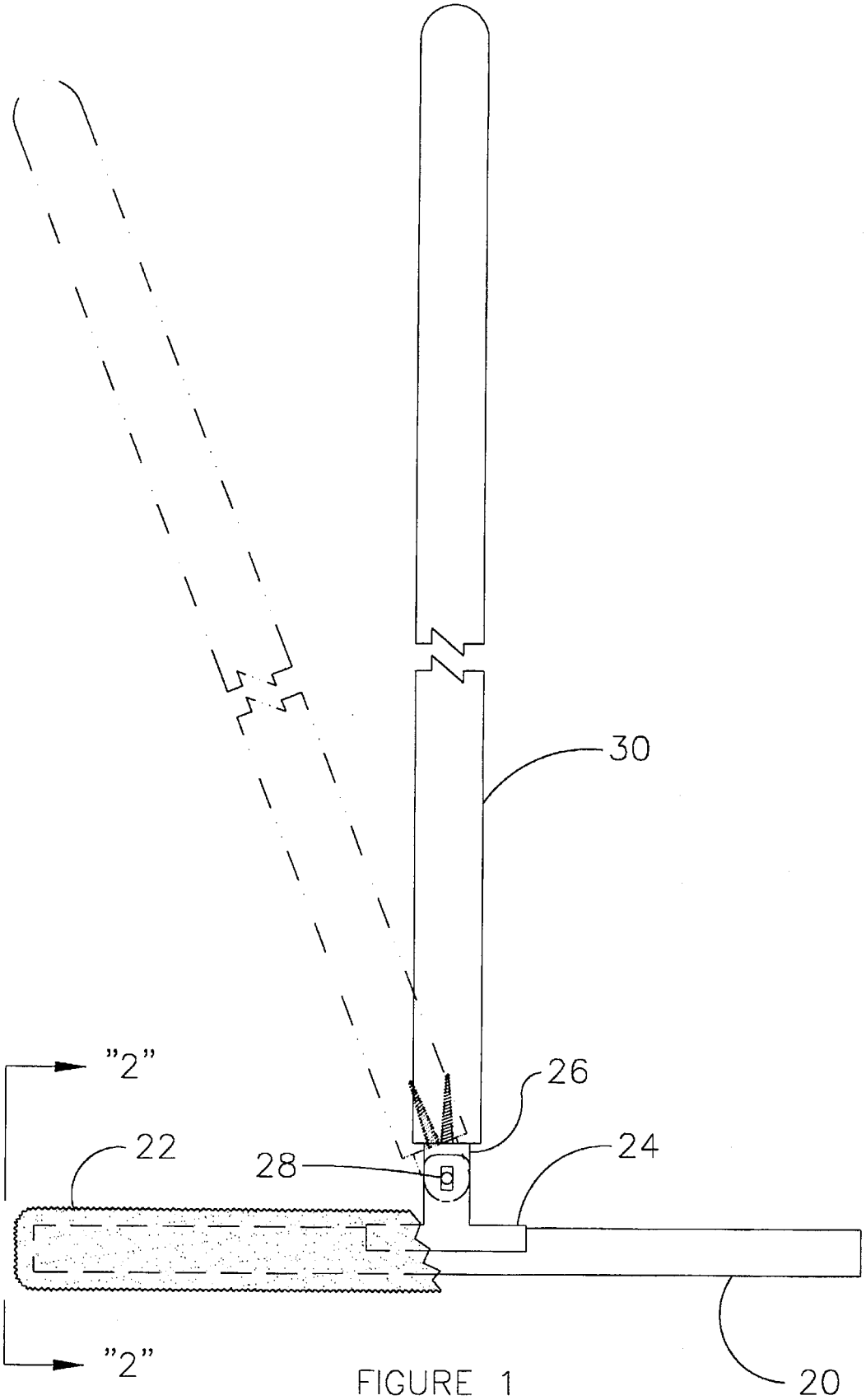
FIG. 1 shows the present invention floor cleaning implement with one half of the sweep/dust sleeve shown

| | |
|---|---|
| 20 elongated head member (tube or rod) | 22 sweeping and dusting sleeve |
| 24 lower half of lateral pivot | 26 upper half of lateral pivot |
| 28 hinge bolt of lateral pivot | 30 handle |
| 32 damp soft cotton cloth towel wiper | 34 grommet |

REFERENCE NUMERALS IN DRAWING

DESCRIPTION OF THE PREFERRED EMBODIMENT

The embodiment of the present invention floor cleaning implement is shown in FIG. 1 in which damp cloth towel wiper 32 has not yet been incorporated. The upper half of lateral pivot 26 screws into the bottom end of a handle 30 (preferably the size of a standard broomstick or slightly larger) until secure and flush with the surface. The upper half of lateral pivot 26 inserts into the lower half of lateral pivot 24 and creates a tongue and fork joint hinge by the insertion of a hinge bolt 28 which is shown in detail in FIG. 2 and FIG. 3. The lower half of lateral pivot 24 is attached to an elongated narrow head member tube or rod 20 by means of a screw on each side of the lower half of lateral pivot 24.

Figure 2:
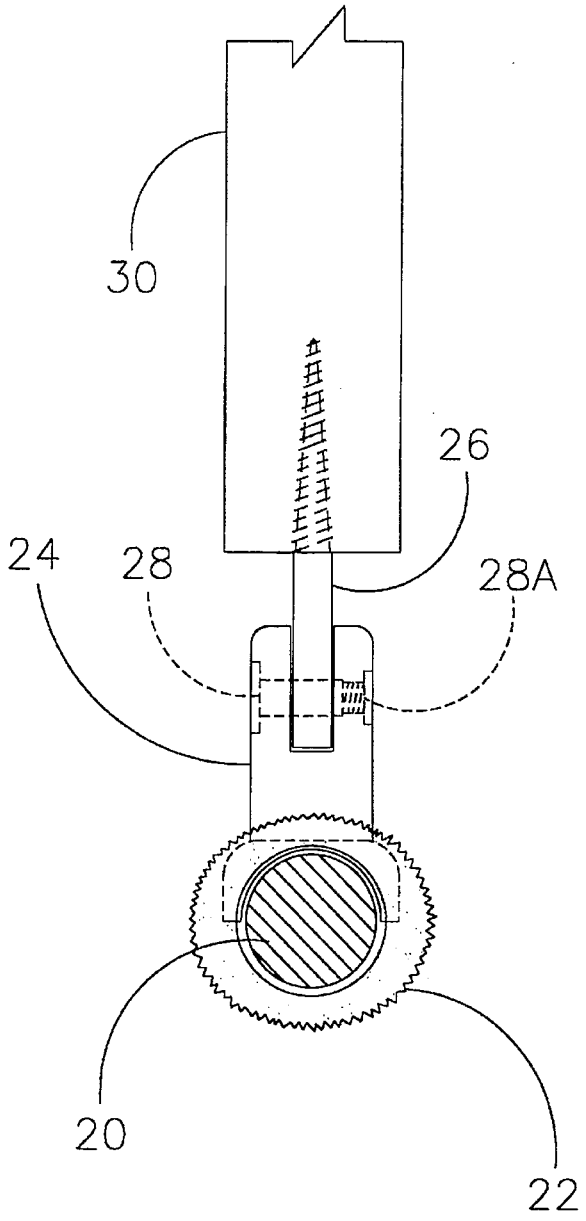
FIG. 2 shows a side cutaway view of the lateral pivot hinge area referred to by lead arrows 2—2 on FIG. 1.
Figure 3:
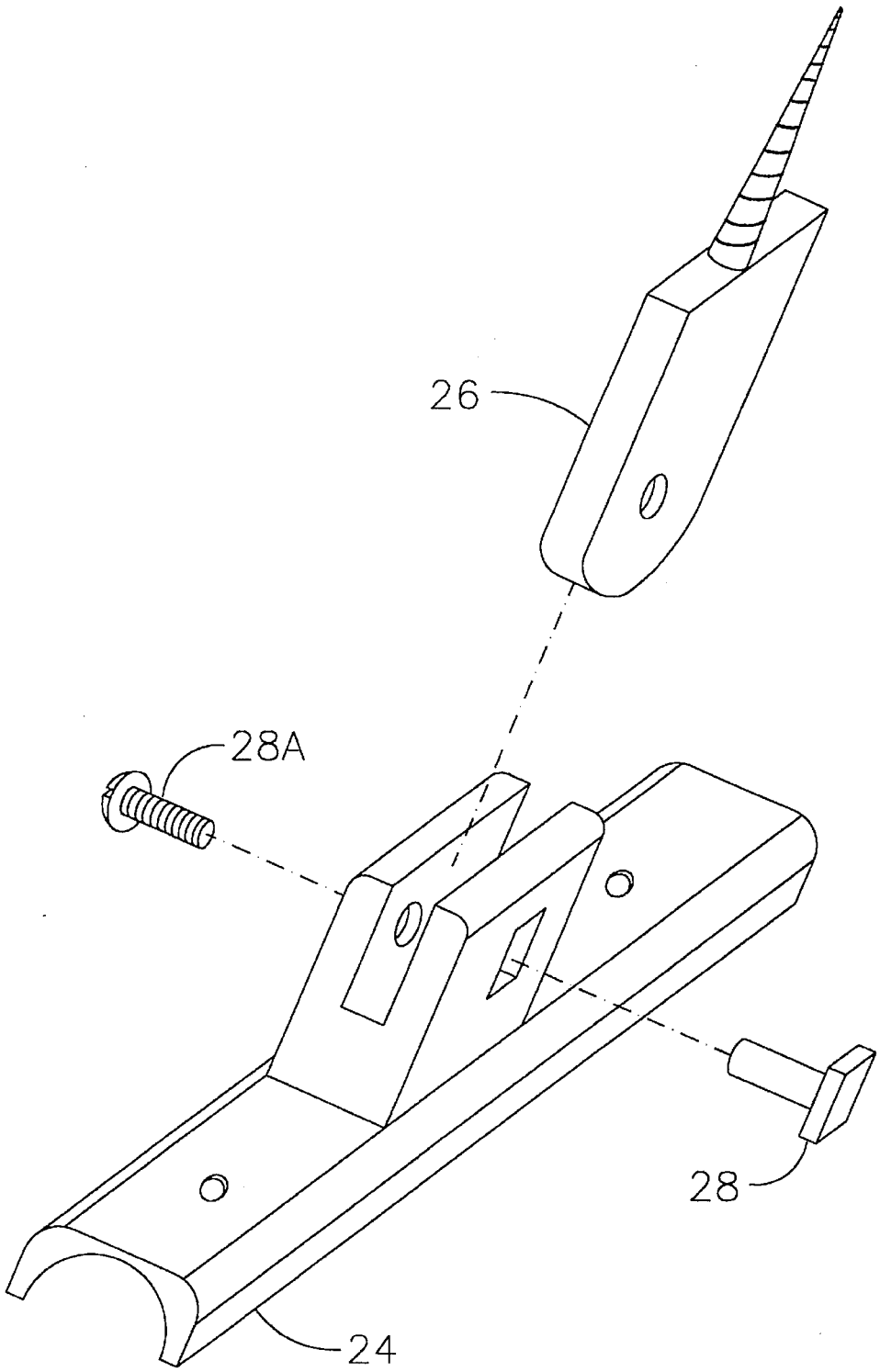
FIG. 3 shows the separate hinge pieces
Figure 4:
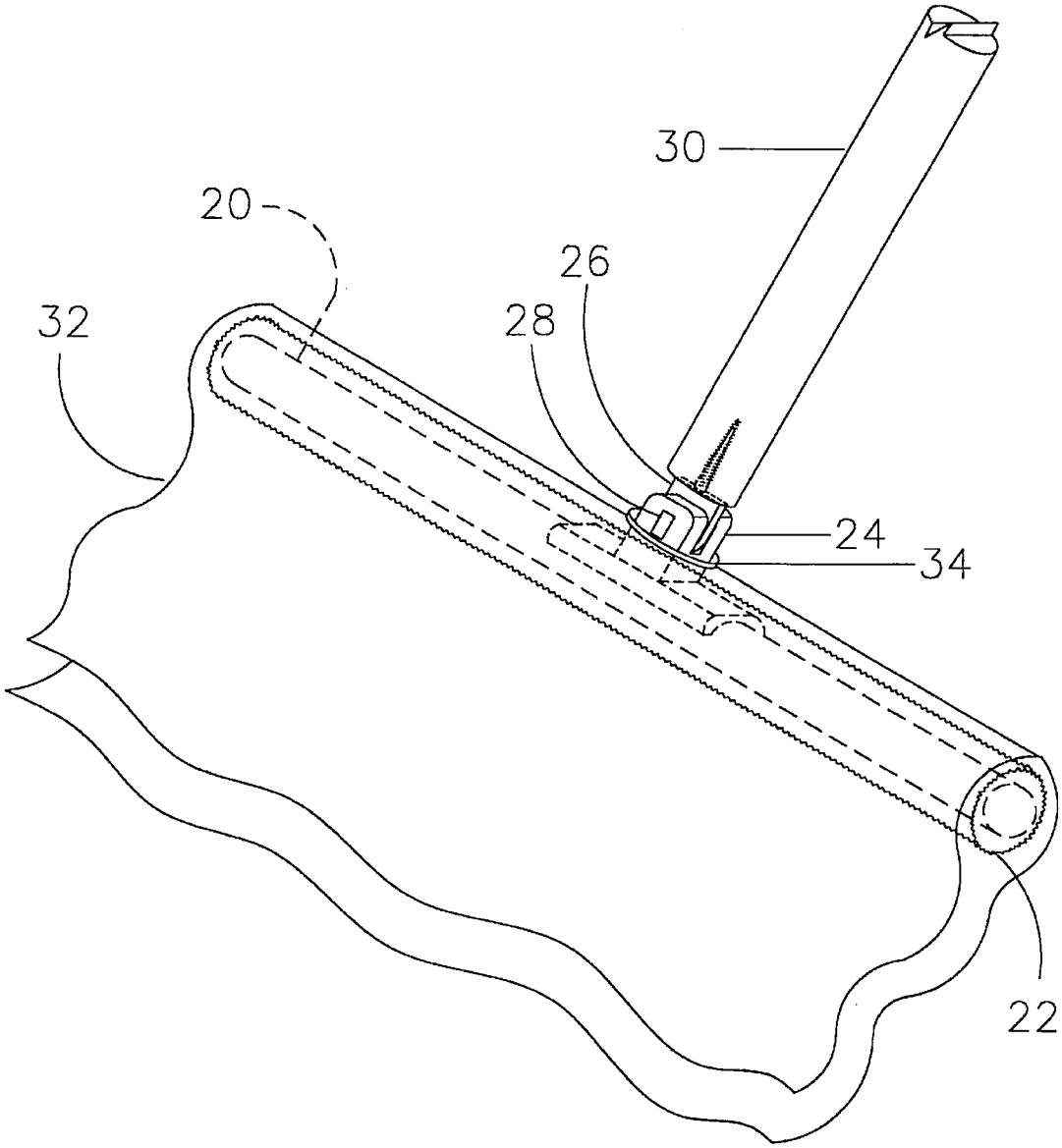
FIG. 4 shows the floor cleaning implement with the damp soft cotton cloth towel installed over the sweep/dust sleeve

A soft, cut-pile, fabric lined, sweep and dust sleeve 22 slips over and encases elongated narrow head member tube or rod 20 (detailed in FIG. 1 and FIG. 2). A damp cloth towel wiper 32 may then be incorporated by sliding a grommet 34, which lines an opening in the center of fabric wiper 32, over and down handle 30, then wiper 32 is draped over sweep/dust sleeve 22, whereby sleeve 22 serves as a cushion for damp mopping (shown in FIG. 4).

The initial step in using the present invention to clean a floor surface is to remove the loose debris and fine dust particles, which is accomplished utilizing the soft, cut pile, fabric lined, sweep/dust sleeve 22.

The sweep/dust sleeve 22 is pre-sewn approximately half way across the top seam which creates a pocket into which the user inserts one half of the head member tube or rod 20. The user next slips the un-sewn half of sweep/dust sleeve 22 on to the remaining half of the head member 20 and secures it by snapping the two standard snaps which are crimped on to opposing sides of the sweep/dust sleeve at the top seam.

Next, the user places the sweep/dust sleeve 22 on to the floor in a starting corner. Using one stroke, the user makes a swipe around the entire perimeter of the floor, returning back to the starting corner. Lightly tap the implement against the floor to remove any debris which is clinging to the sweep/dust sleeve 22 at that corner. Then, the user walks to the opposite end of the floor area and places the sweep/dust sleeve 22 down at one edge of the previously swiped perimeter. Using the preferred side to side "come along" method, the user walks back and forth across the floor, rotating the handle 30 one hundred and eighty degrees at each perimeter edge to reverse the direction of the leading edge of headmember tube or rod 20, and using one continuous swipe stroke, slightly overlapping the previously swiped path (taking one step backwards for each swipe path) and bringing along any dust/debris as he proceeds. If the floor contains more debris than can be brought to the end at one time, the user can make a return swipe with the debris, using the perimeter side path, to the starting/finishing corner and deposit it there and again, lightly tap the implement to remove clinging debris. If the sweep/dust sleeve 22 becomes overly soiled, the implement can be turned upside down by raising headmember tube or rod 20 off of the floor with handle 30, rotating handle 30 one hundred and eighty degrees, and replacing headmember tube or rod 20 on to the floor to employ the clean surface of the sleeve 22 for continued cleaning. When complete, the dust/debris is all in one corner and can be easily disposed of with either a dust pan or hand held vacuum.

The finishing step is that of damp mopping. The user takes the cotton cloth towel wiper 32 and moistens it. Next, the user slides the grommet 34 opening in the center of the cotton cloth towel 32 over the upper end of the handle 30 and down to the sweep/dust sleeve 22. The cotton cloth towel 32 is then draped over the sweep/dust sleeve 22 and positioned so that it trails and free flows behind the head member tube or rod 20 and the sweep/dust sleeve 22. The preferred method of damp mopping is the same technique applied in the sweep/dust step above,namely, starting in one corner and making one continuous stroke the user swipes around the entire perimeter of the floor, returning back to the starting corner. The user then proceeds to the opposite end of the floor and using the preferred side to side "come along" method, walks back and forth across the floor using one continuous stroke, slightly overlapping the previously swiped path (taking one step backwards for each swipe path) as he proceeds. If more dirt is on the floor than one side of the cotton cloth towel 32 can effectively clean, the implement can be turned over thereby incorporating the clean top of the cotton cloth towel 32 for extended cleaning operation. Additionally, if the cotton cloth towel 32 becomes soiled on both exposed surfaces, the towel 32 can be removed by sliding it up the handle 30 and off, turned clean side out, and reinstalled in the previously described manner. If the floor is very large, additional cotton cloth towel wipers 32 can be pre-dampened and quickly changed if necessary by sliding the dirty towel 32 up the handle 30 and off and a clean towel 32 installed in the previously described manner.

When the floor has been completed, the cotton cloth towel(s) 32 and the sweep/dust sleeve 22 can be easily removed by reversing the installation procedure and then easily machine laundered for future re-use.

Although the description above contains many specificities, these should not be construed as limiting the scope of the invention but merely providing illustrations of some of the presently preferred embodiments of this invention. For example, the elongated narrow head member tube or rod can have other shapes such as shorter length for certain special applications, etc.

Thus, the scope of the invention should be determined by the appended claims and their legal equivalents, rather than by the examples given.

I claim:

1. A cleaning apparatus for dry dusting, sweeping and damp mopping a floor, comprising:

an elongated handle a tube having a position perpendicular to one end of said handle such that said tube may be moved on the floor by manipulation of said handle;

a lateral pivot joint coupling said tube to said end of said handle so that said tube may be pivoted laterally from said perpendicular position to other positions on the same plane, on either side of said perpendicular position;

a dry sleeve removably covering said tube, said dry sleeve when moved across the floor, dusts and sweeps the floor for cleaning purposes; and a flexible damp wiper which may be loosely draped in half over said dry sleeve and held in position by said dry sleeve and said tube so that when said tube is moved on the floor, said damp wiper damp mops the floor for cleaning purposes, said dry sleeve providing a cushion means for said damp wiper;

said damp wiper being readily removable from said dry sleeve.

2. The cleaning apparatus of claim 1 in which said damp wiper is a cloth.

3. The cleaning apparatus of claim 2 in which said damp cloth, when soiled on one side, can be turned in side out providing unsoiled damp cloth surface for continued cleaning.

4. The cleaning apparatus of claim 2 in which said damp cloth and dry sleeve can be readily removed, laundered and replaced on said tube.

5. The cleaning apparatus of claim 2 in which said dry sleeve comprises a soft, cut pile material.

6. The cleaning apparatus of claim 2 in which said joint is a tongue and fork joint.

7. The cleaning apparatus of claim 2 in which said damp cloth has a grommet lined opening whereby said damp cloth is additionally held in place by said handle.

8. A cleaning apparatus for dry dusting, sweeping and damp mopping a floor, comprising:

an elongated handle a rod having a position perpendicular to one end of said handle such that said rod may be moved on the floor by manipulation of said handle;

a lateral pivot joint coupling said rod to said end of said handle so that said rod may be pivoted laterally from said perpendicular position to other positions on the same plane, on either side of said perpendicular position;

a dry sleeve removably covering said rod, said dry sleeve when moved across the floor, dusts and sweeps the floor for cleaning purposes; and a flexible damp wiper which may be loosely draped in half over said dry sleeve and held in position by said dry sleeve and said rod so that when said rod is moved on the floor, said damp wiper damp mops the floor for cleaning purposes, said dry sleeve providing a cushion means for said damp wiper;

said damp wiper being readily removable from said dry sleeve.

9. The cleaning apparatus of claim 8 in which said damp wiper is a cloth.

10. The cleaning apparatus of claim 9 in which said damp cloth, when soiled on one side, can be turned in side out providing unsoiled damp cloth surface for continued cleaning.

11. The cleaning apparatus of claim 9 in which said damp cloth and dry sleeve can be readily removed, laundered and replaced on said rod.

12. The cleaning apparatus of claim 9 in which said dry sleeve comprises a soft, cut pile material.

13. The cleaning apparatus of claim 9 in which said joint is a tongue and fork joint.

14. The cleaning apparatus of claim 9 in which said damp cloth has a grommet lined opening whereby said damp cloth is additionally held in place by said handle.

* * * * *

UNITED STATES PATENT AND TRADEMARK OFFICE

CERTIFICATE OF CORRECTION

PATENT NO. : 5,655,250

DATED : August 12, 1997

INVENTOR(S) : Ann M. Warrell

It is certified that error appears in the above-identified patent and that said Letters Patent is hereby corrected as shown below:

Column 1, line 40, after "particles" insert --and--.
Column 2, line 26, change "requiting" to --requiring--.
Column 2, line 43, change "tire" to --time--.
Column 2, line 60, change "attaachment" to --attachment--.
Column 3., line 23, insert --Reference Numerals In Drawing--.
Column 3, line 31, delete "Reference Numerals In Drawing".

Signed and Sealed this

Twenty-eighth Day of October, 1997

*Attest:*

Bruce Lehman

BRUCE LEHMAN

*Attesting Officer*

*Commissioner of Patents and Trademarks*